US006998592B2

(12) United States Patent
Ryu

(10) Patent No.: US 6,998,592 B2
(45) Date of Patent: Feb. 14, 2006

(54) MICROWAVE OVEN AND METHOD OF CONTROLLING THE SAME

(75) Inventor: Han-Gyu Ryu, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 182 days.

(21) Appl. No.: 10/671,599

(22) Filed: Sep. 29, 2003

(65) Prior Publication Data

US 2004/0149745 A1 Aug. 5, 2004

(30) Foreign Application Priority Data

Dec. 28, 2002 (KR) ..... 10-2002-0085719

(51) Int. Cl.
*H05B 6/68* (2006.01)

(52) U.S. Cl. ..... 219/720; 219/702

(58) Field of Classification Search ..... 219/720, 219/702, 714, 718, 721, 725, 708, 712, 492, 219/493, 497, 481, 501, 505, 506, 518; 713/340; 700/293, 295

See application file for complete search history.

(56) References Cited

U.S. PATENT DOCUMENTS

| | | | | |
|---|---|---|---|---|
| 4,356,370 | A | 10/1982 | Horinouchi | |
| 4,841,125 | A | 6/1989 | Edamura | |
| 5,274,209 | A * | 12/1993 | Edamura | 219/714 |
| 5,968,393 | A * | 10/1999 | Demaline | 219/492 |
| 6,097,016 | A * | 8/2000 | Hirata et al. | 219/720 |
| 6,388,238 | B1 | 5/2002 | Head | |
| 2001/0038008 | A1 | 11/2001 | Head | |

FOREIGN PATENT DOCUMENTS

| | | |
|---|---|---|
| EP | 0 818 942 | 1/1998 |
| GB | 2 239 330 | 6/1991 |

* cited by examiner

*Primary Examiner*—Quang Van
(74) *Attorney, Agent, or Firm*—Staas & Halsey LLP

(57) ABSTRACT

A microwave oven and a method of controlling the same. The microwave oven includes a control unit having an internal storage unit to store cooking data and/or operational data to perform one or more existing cooking modes. An external storage unit is arranged independently from the control unit and is electrically connected to the control unit to communicate with the control unit, and stores cooking data and/or the operational data to perform one or more new cooking modes.

15 Claims, 5 Drawing Sheets

FIG. 4

| |
|---|
| BLK1 : INFORMATION OF MICROWAVE OVEN MODEL TO WHICH EXTERNAL MEMORY IS APPLIED |
| BLK2 : COOKING DATA OF EXISTING COOKING MODES ( #1 , #2 , #3 , #4 ) |
| BLK3 : COOKING DATA OF NEW COOKING MODES ( #5 , #6 ) |
| BLK4: OPERATIONAL DATA OF NEW COOKING MODES (#5, #6) |

MICROWAVE OVEN AND METHOD OF CONTROLLING THE SAME

CROSS-REFERENCE TO RELATED APPLICATION

This application claims the benefit of Korean Application No. 2002-85719, filed Dec. 28, 2002, in the Korean Intellectual Property Office, the disclosure of which is incorporated herein by reference.

BACKGROUND OF THE INVENTION

1. Field of the Invention

The present invention relates, in general, to cooking machines and, more particularly, to a microwave oven which cooks foods using microwaves.

2. Description of the Related Art

As is well known to those skilled in the art, a microwave oven heats food by radiating microwaves of a frequency of 2450 MHz generated from a magnetron onto the food. When the microwaves oscillate food molecules, heat is generated due to a collision of the food molecules, and the food is then cooked by the heat.

FIG. 1 is a block diagram of a conventional microwave oven. As shown in FIG. 1, a control unit 102 that controls an entire operation of the conventional microwave oven has an internal memory 102*a* therein. The internal memory 102*a* stores operational data (for example, algorithmic data and/or HELP data) and/or cooking data required to perform various cooking modes. An input terminal of the control unit 102 is connected to an input unit 104 and an external memory 106. On the input unit 104, cooking mode selection buttons and/or numerical buttons are mounted to allow a user to select cooking modes or cooking times. The external memory 106, which is a storage device to supplement the internal memory 102*a* of the control unit 102, stores the cooking data of respective cooking modes. An output terminal of the control unit 102 is connected to a magnetron driving unit 108, a fan driving unit 112, a tray motor driving unit 116 and a display driving unit 120. The magnetron driving unit 108 drives a magnetron 110 to generate microwaves. The fan driving unit 112 drives a cooling fan 114 to cool various electrical devices mounted in a machine room (not shown) of the conventional microwave oven. The tray motor driving unit 116 drives a tray motor 118 to rotate a cooking tray (not shown) in a cooking cavity (not shown). The display driving unit 120 drives a display unit 122 to display, for example, HELP data, cooking information and preset values for cooking modes.

If a new cooking mode is added to the conventional microwave oven, cooking data and (operational) data relating to the new cooking mode must be added. In this case, if the internal memory 102*a* of the control unit 102 used in the conventional microwave oven is a Read Only Memory (ROM) supporting only reading of data, update of the data is not possible, so the data relating to the new cooking mode must be stored in the external memory 106. However, the conventional microwave oven is designed such that the external memory 106 is limited to a storage of the cooking data of respective cooking modes. For example, the external memory 106 of the conventional microwave oven stores the cooking data, such as a cooking time and an output value of a magnetron according to an amount of the food in each of the cooking modes. Consequently, if the cooking mode is newly added, a burden is generated in that a new control unit must be developed to store additional operational data of the added cooking mode in the internal memory 102*a* of the new control unit.

SUMMARY OF THE INVENTION

Accordingly, it is an aspect of the present invention to provide a microwave oven and a method of controlling the same, which may reduce developing costs and selling prices by allowing a conventional control unit to be commonly applied to various microwave ovens when microwave ovens having new operations are developed.

Additional aspects and/or advantages of the invention will be set forth in part in the description which follows and, in part, will be obvious from the description, or may be learned by practice of the invention.

The above and/or other aspects are achieved by providing a microwave oven including a control unit to store cooking data and/or operational data required to perform one or more existing cooking modes. An external storage unit is arranged independently from the control unit and is electrically connected to the control unit and capable of communicating with the control unit. Further, the external storage unit stores the cooking data and/or the operational data required to perform one or more new cooking modes.

In the microwave oven, the external storage unit has a data storage configuration including a first storage field to store application status information of said external storage unit, a second storage field to store cooking data of the existing cooking modes, a third storage field to store cooking data of the new cooking modes, and a fourth storage field to store operational data of the new cooking modes.

The above and/or other aspects are achieved by providing a method of controlling the microwave oven having the above-mentioned construction. In the microwave oven control method, a first cooking mode is performed by reading the cooking data and/or the operational data of the first cooking mode from the external storage unit when the first cooking mode is set, the reading of data from the external storage unit is possible, and the first cooking mode is one of the new cooking modes. Further, a second cooking mode is performed by reading the operational data of the second cooking mode from the internal storage unit and reading the cooking data thereof from the external storage unit when the second cooking mode is set, reading the data from the external storage unit is possible, and the second cooking mode is one of the existing cooking modes. Further, a third cooking mode is performed by reading the cooking data and/or the operational data of the third cooking mode from the internal storage unit when the third cooking mode is set, reading the data from the external storage unit is impossible, and the third cooking mode is one of the existing cooking modes.

BRIEF DESCRIPTION OF THE DRAWINGS

These and/or other aspects and advantages of the invention will become apparent and more readily appreciated from the following description of the preferred embodiments, taken in conjunction with the accompanying drawings of which:

FIG. 4 is a view showing a data storage configuration of an external memory according to the embodiment of the present invention.

DETAILED DESCRIPTION OF THE PREFERRED EMBODIMENT

Figure 1:
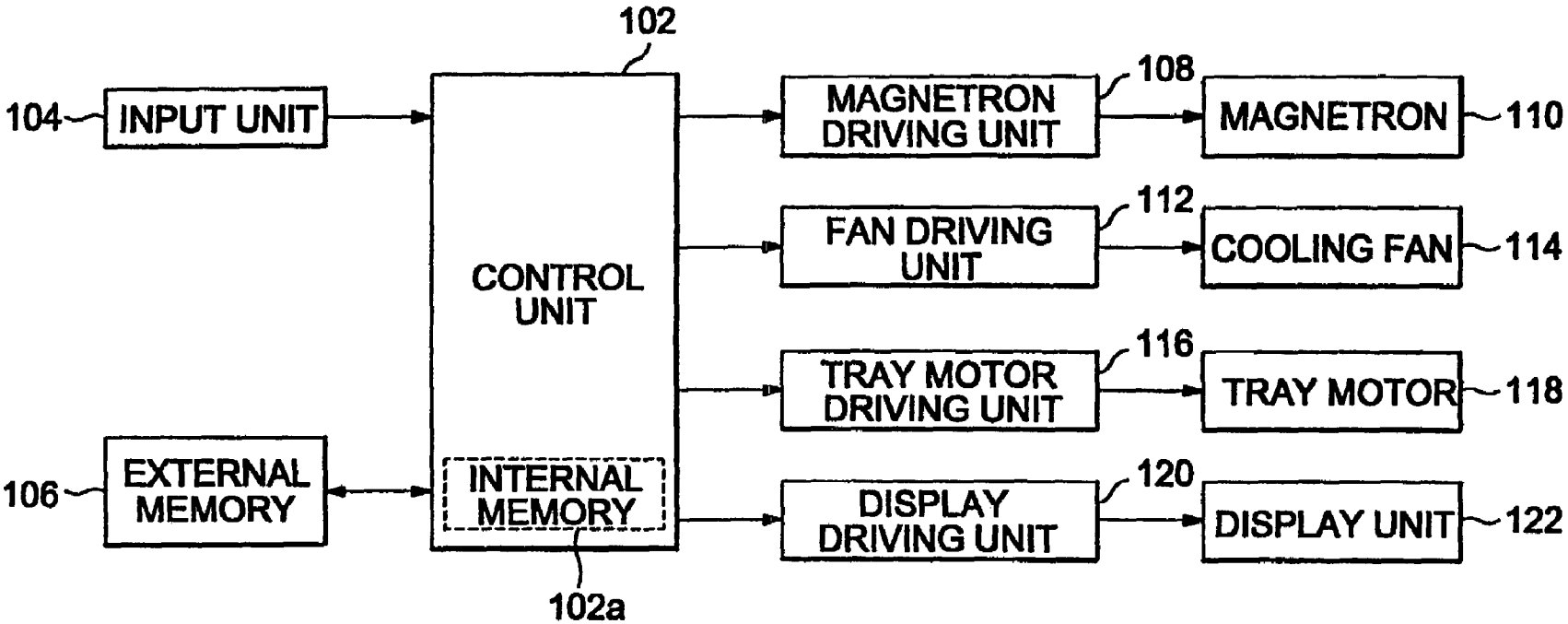
FIG. 1 (PRIOR ART)
FIG. 1 is a block diagram of a conventional microwave oven.

Reference will now be made in detail to the present preferred embodiment of the present invention, examples of which are illustrated in the accompanying drawings, wherein like reference numerals refer to the like elements throughout. The embodiment is described below in order to explain the present invention by referring to the figures.

Figure 2:
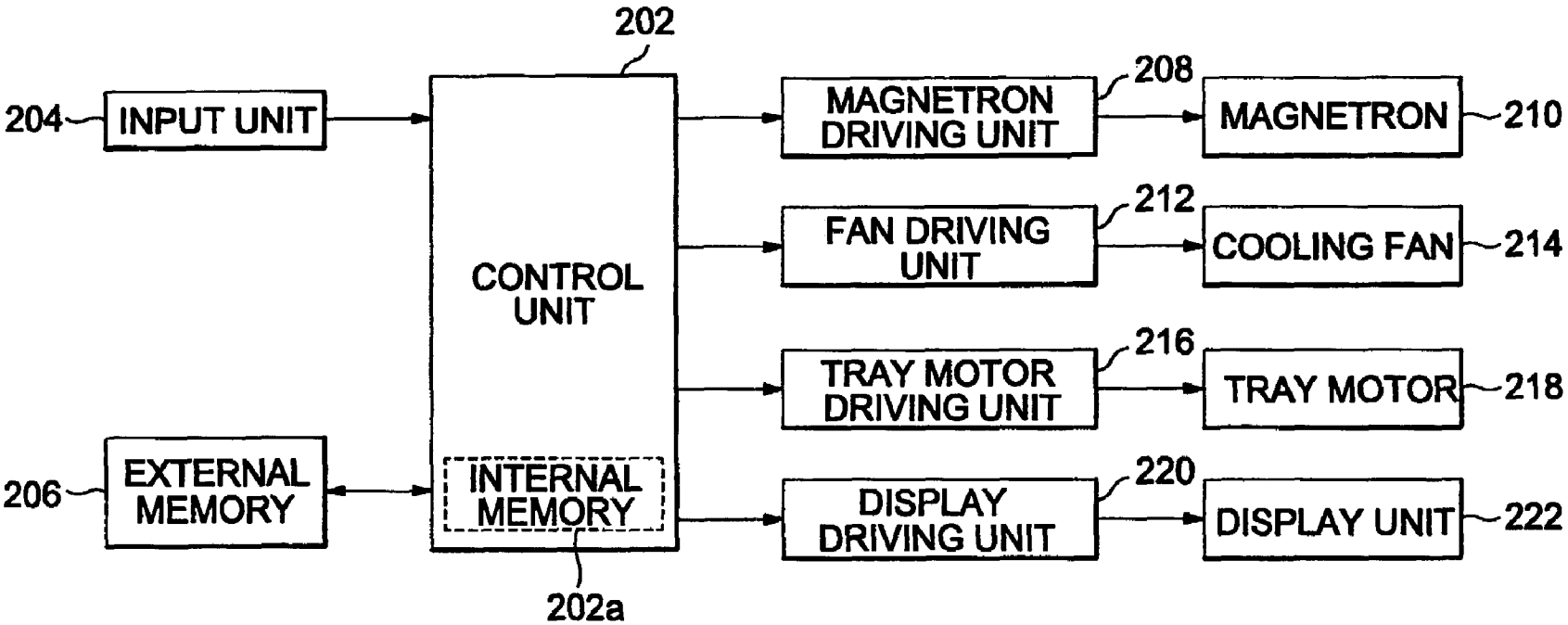
FIG. 2 is a block diagram of a microwave oven, according to an embodiment of the present invention.

Embodiments of a microwave oven and a method of controlling the same according to the present invention will be described in detail with reference to FIGS. 2 to 5. FIG. 2 is a block diagram of a microwave oven according to an embodiment of the present invention. As shown in FIG. 2, a control unit 202 that controls an entire operation of the microwave oven includes an internal memory 202*a* therein. The internal memory 202*a* is a storage device to store operational data and/or cooking data required to perform various cooking modes. The cooking data are values relating to appropriate cooking times and output values of a magnetron according to a type and an amount of food to be cooked. Further, the operational data are HELP messages displayed via a display unit 222 when certain food is cooked, or ranges of preset values which may be selected by a user. An input terminal of the control unit 202 is connected to an input unit 204 and an external memory 206. On the input unit 204, cooking mode selection buttons or numerical buttons are mounted to allow the user to select cooking modes or cooking times. The external memory 206, which is a storage device supplementing the internal memory 202*a* of the control unit 202, can be a non-volatile memory device supporting rewriting of data, such as Electrically Erasable Programmable Read Only Memory (EEPROM) and may store cooking data and operational data of newly added cooking modes, together with other cooking data of existing cooking modes. An output terminal of the control unit 202 is connected to a magnetron driving unit 208, a fan driving unit 212, a tray motor driving unit 216 and a display driving unit 220. The magnetron driving unit 208 drives a magnetron 210 to generate microwaves. The fan driving unit 212 drives a cooling fan 214 to cool various electrical devices mounted in a machine room (not shown) of the microwave oven. The tray motor driving unit 216 drives a tray motor 218 to rotate a cooking tray (not shown) in a cooking cavity (not shown). The display driving unit 220 drives the display unit 222 to display HELP data and preset values for a corresponding cooking mode, and progress of cooking in the corresponding cooking mode.

In the external memory 206 of the microwave oven, the cooking data and operational data of the newly added cooking modes as well as the cooking data of the existing cooking modes, are stored, so the cooking data and the operational data may be manipulated in actual cooking modes.

Figures 3A, 3B:
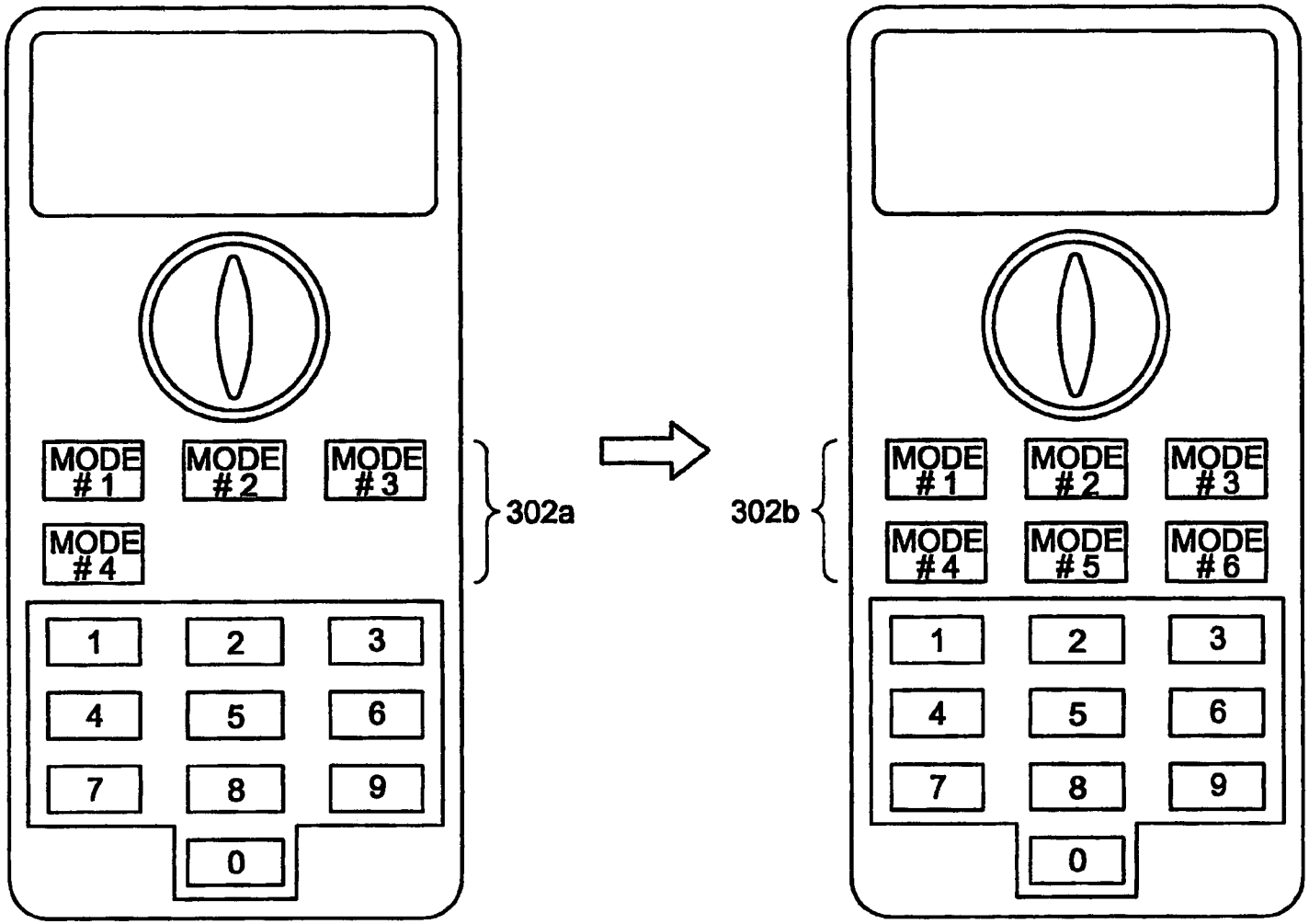
FIGS. 3A and 3B are views showing an input unit of the microwave oven of FIG. 2 to define existing cooking modes and newly added cooking modes.

Definitions for the existing cooking modes and the newly added cooking modes are described with reference to FIGS. 3A and 3B. FIGS. 3A and 3B are views showing the input unit of the microwave oven of FIG. 2. FIG. 3A shows an input unit of a microwave oven having four cooking modes #1 to #4. The four cooking modes #1, #2, #3 and #4 may be selected through cooking mode selection buttons 302*a*. In this case, operational data, such as algorithmic data (i.e., coding data which is used to control an overall operation of the microwave oven) and/or HELP data relating to the four cooking modes #1 to #4, are stored in the internal memory 202*a* of the control unit 202. Further, cooking data of the four cooking modes #1 to #4 are stored in the external memory 206. A second microwave oven in which two cooking modes #5 and #6 are added to the four cooking modes #1 to #4 may be developed, and the input unit may be constructed as shown in FIG. 3B. Existing and new cooking modes may be selected through cooking mode selection buttons 302*b* in FIG. 3B. In the second microwave oven, in which the cooking modes #5 and #6 are added, new operational data and cooking data must be stored to control the added cooking modes #5 and #6. The control unit 202 must implement the existing and new cooking modes by manipulating the new operational and cooking data. With the existing cooking modes existing prior to the new cooking modes, which are being added, the internal memory 202*a* of the microwave oven stores the operational data and/or the cooking data of the existing cooking modes. Further, the external memory 206 stores the operational and cooking data of the new cooking modes, together with the cooking data of the existing cooking modes which were not stored, in advance, in the internal memory 202*a*. Therefore, if a selected cooking mode is one of the existing cooking modes, the control unit 202 of the microwave oven reads the operational and cooking data from the internal memory 202*a*, and, if necessary, reads the cooking data from the external memory 206, thus performing a corresponding cooking mode (existing cooking mode). However, if the selected cooking mode is one of the newly added cooking modes, the control unit 202 reads the operational and cooking data of the corresponding cooking mode from the external memory 206 to perform a cooking operation.

FIG. 4 is a view showing a data storage configuration of the external memory 206 in the microwave oven of the embodiment of the present invention. As shown in FIG. 4, a first block BLK1 of the external memory 206 is used to store information (model number) of a microwave oven model to which an external memory is applied. A second block BLK2 is used to store cooking data of existing cooking modes #1 to #4, and a third block BLK3 is used to store cooking data of new cooking modes #5 and #6. A fourth block BLK4 is used to store operational data of the new cooking modes #5 and #6. The control unit 202 controls an entire operation of the microwave oven by reading data of a cooking mode selected by the user from the internal memory 202*a* and/or the external memory 206 to perform a corresponding cooking operation.

Figure 5:
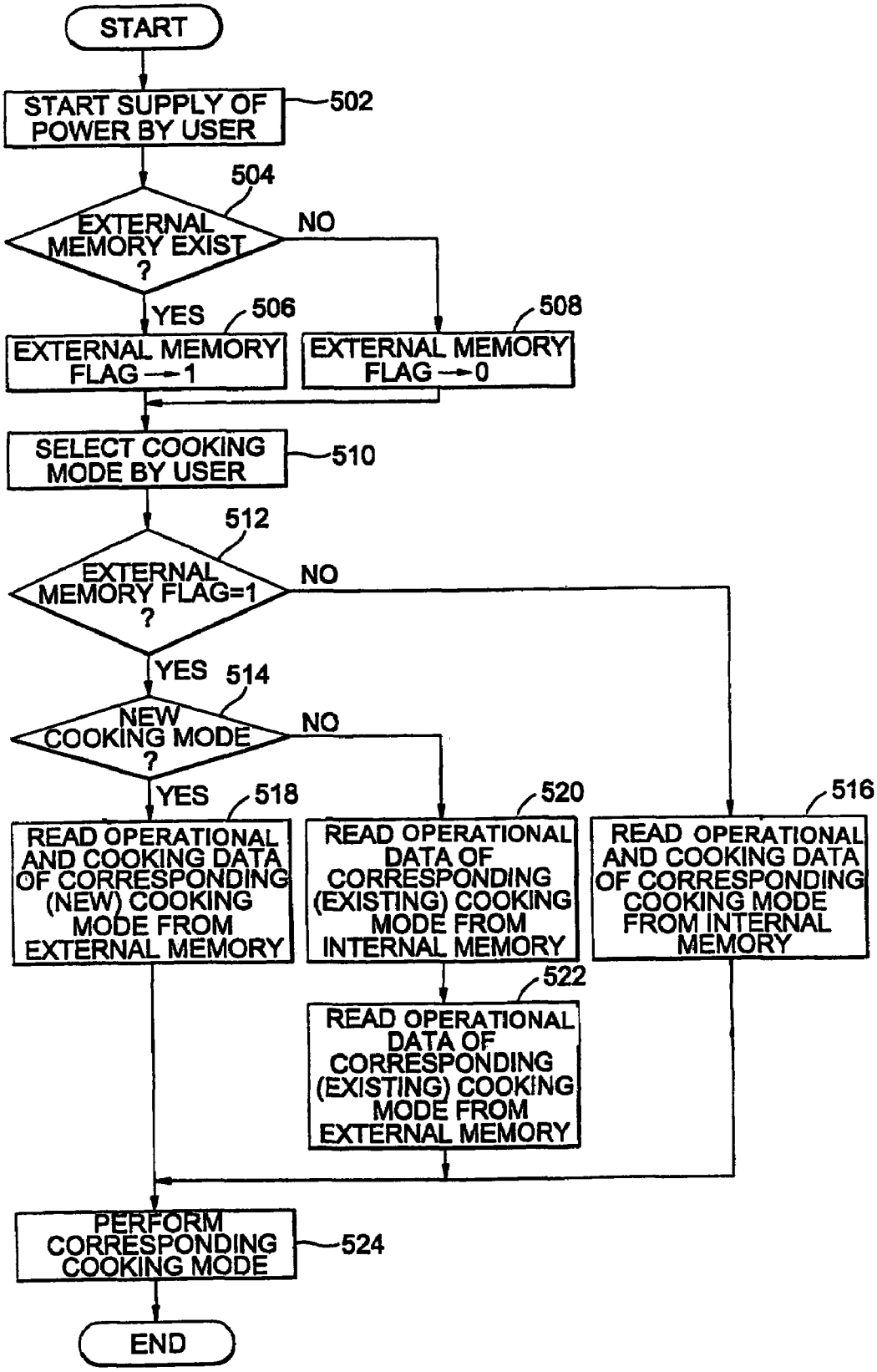
FIG. 5 is a flowchart of a data read control algorithm based on the existing and newly-added cooking modes of the microwave oven, according to the embodiment of the present invention.

A method of controlling the microwave oven having the above construction according to the embodiment of the present invention is described in detail with reference to FIG. 5. FIG. 5 is a flowchart of a data read control algorithm based on cooking modes of the microwave oven. As shown in FIG. 5, when a power switch of the microwave oven is turned on by the user to start a supply of power in operation 502, the control unit 202 checks whether the external memory 206, which may be electrically connected to the control unit 202, exists in operation 504. If the external memory 206 exists, the control unit 202 sets an external memory flag value to "1" in operation 506. If the external memory 206 does not exist, or if required data are not stored in the external memory 206 even through the external memory 206 exists, the control unit 202 resets the external memory flag value to "0" in operation 508. The external memory flag value, determined according to whether the external memory 206 exists after the supply of the power, is utilized in all later cooking modes performed until the supply of the power is turned off.

At this time, if a cooking mode is selected by the user in operation 510, the control unit 202 checks whether the external memory flag value is "1" in operation 512. If the external memory flag value is "1", the control unit 202 checks whether the selected cooking mode is a new cooking mode in operation 514. If the external memory flag value is "0", the external memory 206 does not exist, or the required data are not stored in the external memory 206. Accordingly, the control unit 202 accesses the internal memory 202*a* to read the operational data and the cooking data of a corresponding cooking mode therefrom in operation 516.

If the selected cooking mode is a new cooking mode, the control unit 202 accesses the external memory 206 to read the operational data and the cooking data of the corresponding cooking mode therefrom in operation 518. If the selected cooking mode is an existing cooking mode, the control unit 202 accesses the internal memory 202*a* to read the operational data of the corresponding cooking mode therefrom in operation 520, and then accesses the external memory 206 to read the cooking data of the corresponding cooking mode therefrom in operation 522. If the required data are read with respect to respective cases, the control unit 202 controls the entire operation of the microwave oven to perform the corresponding cooking mode in operation 524.

As is apparent from the above description, a microwave oven and a method of controlling the same allows a conventional control unit to be commonly applied to various microwave ovens by storing both cooking data and the operational data of newly added cooking modes in an external memory when the microwave ovens in which new operations are added are developed. Accordingly, the present invention is advantageous in that specifications of the conventional control unit (for example, a microcomputer), used in previously developed microwave ovens, may be utilized in the newly developed microwave ovens, thus greatly reducing a time and a cost required to develop a new control unit.

Although an embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A microwave oven, comprising:

a control unit having an internal storage unit to store cooking data and/or operational data required to perform one or more existing cooking modes; and an external storage unit arranged independently from the control unit and electrically connected to the control unit to communicate with the control unit, the external storage unit storing cooking data and/or operational data required to perform one or more new cooking modes, wherein the external storage unit has a data storage configuration, the data storage configuration comprising:

a first storage field to store application status information of the external storage unit;

a second storage field to store the cooking data of the one or more existing cooking modes;

a third storage field to store the cooking data of the one or more new cooking modes and;

a fourth storage field to store operational data of the one or more new cooking modes.

2. The microwave oven according to claim 1, further comprising:

a magnetron to generate microwaves to heat food, wherein said cooking data comprises:

cooking times and output values of the magnetron according to a type and an amount of the food.

3. The microwave oven according to claim 1, further comprising:

a display unit to display cooking information required to cook food and/or cooking status information generated when the food is cooked, wherein the operational data comprise:

the cooking information and/or the cooking status information.

4. The microwave oven according to claim 1, wherein said external storage unit comprises:

a non-volatile memory device supporting rewriting of data.

5. The microwave oven according to claim 1, wherein said external storage unit comprises:

an Electrically Erasable Programmable Read Only Memory (EEPROM).

6. A microwave oven, comprising:

a control unit having an internal storage unit therein to store data required for one or more existing cooking modes; and an external storage unit, separate from the control unit, communicating with and controlled by the control unit, the external storage unit storing at least operational data required for one or more new cooking modes, wherein the external storage unit includes a data configuration, comprising:

a first field to store status information of the external storage unit;

a second field to store cooking data of the one or more existing cooking modes;

a third field to store cooking data of the one or more new cooking modes; and a fourth field to store operational data of the one or more new cooking modes.

7. The microwave oven according to claim 6, wherein:

the data stored in the internal storage unit comprises:

predetermined cooking and operational data of the one or more existing cooking modes; and the data stored in the external storage unit comprises:

cooking data and the operational data in accordance with the one or more new cooking modes and other cooking data of the one or more existing modes which are not stored, in advance, in the internal storage unit.

8. The microwave oven according to claim 7, further comprising:

a display unit, wherein the operational data of the new and existing cooking modes comprises:

help messages to be displayed on the display unit.

9. The microwave oven according to claim 8, wherein the operational data of the new and existing cooking modes further comprises:

control algorithms based on the new and existing cooking modes.

10. The microwave oven according to claim 6, further comprising:

a magnetron to generate microwaves to heat food, wherein the data required for the existing and new cooking modes comprises:

cooking times and output values of the magnetron according to a type and an amount of the food.

11. The microwave oven according to claim 6, further comprising:

a display unit to display cooking information required to cook food and/or cooking status information generated when the food is cooked, wherein the data required for existing and new cooking modes stored in the internal and external storage units, respectively, comprises:

the cooking information and/or the cooking status information.

12. The microwave oven according to claim 6, wherein the external storage unit comprises:

a non-volatile memory device supporting rewriting of data.

13. The microwave oven according to claim 6, wherein said external storage unit comprises:

an Electrically Erasable Programmable Read Only Memory (EEPROM).

14. A microwave oven, comprising:

a control unit having an internal storage unit to store data required to perform one or more existing cooking modes; and an external storage unit separate from the control unit communicating with the control unit, the external storage unit storing required data in a data configuration comprising;

a first field to store application state information of the external storage unit, a second field to store data of the one or more existing cooking modes, a third field to store cooking data of the one or more new cooking modes, and a fourth field to store operational data of the one or more new cooking modes.

15. A microwave oven, comprising:

a controller having an internal storage unit to transmit stored predefined data therefrom; and an external storage unit separate from the controller communicating with the controller, the external storage unit storing at least additional operational data and transmitting the stored additional data when accessed by the controller such that the internal storage unit of the controller and the external storage unit work as one unit in which the predefined data is stored in the internal storage unit and the at least additional operational data is stored in the external storage unit, and the at least additional operational data is stored after the predefined data in the internal storage unit is stored, wherein the external storage unit includes a data configuration, comprising:

a first field to store status information of the external storage unit;

a second field to store cooking data of the one or more existing cooking modes;

a third field to store cooking data of the one or more new cooking modes; and a fourth field to store operational data of the one or more new cooking modes.

* * * * *

UNITED STATES PATENT AND TRADEMARK OFFICE

CERTIFICATE OF CORRECTION

PATENT NO. : 6,998,592 B2
APPLICATION NO. : 10/671599
DATED : February 14, 2006
INVENTOR(S) : Han-Gyu Ryu It is certified that error appears in the above-identified patent and that said Letters Patent is hereby corrected as shown below:

Col. 6, Line 2, delete “modes and;” and insert --modes; and-- therefor.

Signed and Sealed this

Seventh Day of November, 2006

JON W. DUDAS
*Director of the United States Patent and Trademark Office*